US005306362A

United States Patent [19]

Gupta et al.

[11] Patent Number: 5,306,362

[45] Date of Patent: Apr. 26, 1994

[54] ALUMINUM ALLOY AND METHOD OF MAKING

[75] Inventors: Alok K. Gupta; David J. Lloyd; Pierre H. Marois, all of Kingston, Canada

[73] Assignee: Alcan International Limited, Montreal, Canada

[21] Appl. No.: 950,423

[22] Filed: Sep. 23, 1992

Related U.S. Application Data

[63] Continuation-in-part of Ser. No. 734,619, Jul. 23, 1991, abandoned.

[51] Int. Cl.[5] ..... C22F 1/04

[52] U.S. Cl. ..... 148/552; 148/695; 148/696; 148/697; 148/700; 148/417; 148/439; 420/534; 420/538

[58] Field of Search ..... 148/417, 439, 552, 695, 148/696, 697, 700; 420/534, 538

[56] References Cited

U.S. PATENT DOCUMENTS 4,838,958 6/1989 Komatsubara et al. ..... 148/700
4,840,852 6/1989 Hyland ..... 148/439
4,909,861 3/1990 Muraoka ..... 148/439
5,061,327 10/1991 Denzer ..... 148/439

FOREIGN PATENT DOCUMENTS 531118 9/1992 European Pat. Off. .
210768 9/1985 Japan .
267714 10/1987 Japan .
2-05660 8/1990 Japan .

*Primary Examiner*—W. Dean
*Assistant Examiner*—Robert R. Koehler
*Attorney, Agent, or Firm*—Cooper & Dunham

[57] ABSTRACT

The invention provides an aluminum alloy material consisting essentially of, by weight percent, 1% to 1.8% Cu, 0.8% to 1.4% Mg, 0.2% to 0.39% Si, 0.5% to 0.4% Fe, 0.05% to 0.40% Mn, with the balance aluminum with normal impurities. The alloy forms two precipitation phases during heat treatment and age hardening: a beta phase of $Mg_2Si$ and an S' phase of $Al_2CuMg$. The alloy has improved formability without significant sacrifice of strength, and is particularly suited to be formed into automobile sheet metal parts such as hood lids, trunks lids, and fenders.

21 Claims, No Drawings

ALUMINUM ALLOY AND METHOD OF MAKING

FIELD OF THE INVENTION

This application is a continuation-in-part of U.S. patent application Ser. No. 734,619, filed on Jul. 23, 1991, the entire contents of which is incorporated herein by reference.

This invention relates to improved aluminum alloys and products made therefrom, particularly aluminum alloys including magnesium, copper, and silicon having improved strength and formability properties. The present invention also relates to processes for producing such alloys, as well as aluminum alloy sheets and articles fabricated therefrom and to the products of such processes.

BACKGROUND OF THE INVENTION

Aluminum alloys are enjoying growing use as automobile parts and are rolled into sheets which may be stamped into hoods, trunk lids, doors, and fenders, and the like from the aluminum alloy sheet. At present, however, none of the existing aluminum alloys suitable for use in forming automobile panels and parts appears to satisfy the specifications of the various automotive companies, as the standards tend to differ from one company to the other. For example, one company's requirements may emphasize alloy strength (e.g., a yield strength in excess of 25 ksi), while other companies may prefer a softer alloy (e.g., a 15-18 ksi yield strength in the as delivered state), which has superior formability properties. Often, improvements in an alloy's formability decreases the ability of heat treatment of the alloy to improve its strength. As such, there exists a need for an alloy which may be formed easily into automotive body panels, but which has good age hardening properties so that when the alloy panels are heat treated, such as during the paint baking cycle, the strength of the alloy increases.

Various studies and previous attempts have been made to develop improved aluminum alloys which may be suitable for use in manufacturing automobile body panels, for example, and which have a composition displaying good age A hardening properties. For example, U.S. Pat. No. 4,838,958 (Komatsubara) discusses a T-4 tempered and straightened rolled sheet Al-Mg-Cu series aluminum alloy which according to the patentees contains from 1.5 to 5.5% by weight of magnesium and 0.18 to 1.5% by weight of copper as the essential alloying ingredients, in an effort to improve mechanical properties, formability, and to help avoid formation of Luder's marks. U.S. Pat. No. 4,589,932 (Park) appears to pertain to an alloy composition containing 0.4% to 1.2% Si, 0.5% to 1.3% Mg, 0.6% to 1.1% Cu, and 0.1% to 1% Mn. The patentee states that the alloy is responsive to high temperature artificial aging treatments.

In U.S. Pat. No. 4,637,842 (Jeffrey et al.), the patentees discuss a method for producing Al-Mg-Si alloy sheets and articles. The patentees, however, do not attempt to create phases in an effort to improve the age hardening properties of the alloy.

U.S. Pat. No. 4,113,472 (Fister) proposes an aluminum alloy containing 0.9 to 1.5% magnesium, 0.4 to 0.8% silicon, and 0.9 to 1.5% copper, which purports to give the alloy high strength, extrudability, and weldability.

However, the foregoing alloys require very close control over the natural and artificial aging cycle if appropriate combinations of strength and formability are to be achieved. In practice it is important that the T4 strength be relatively low, and the natural aging rate be slow, so that good formability can be maintained over a long period of time. Subsequently the alloy needs to show a high precipitation hardening response during the paint bake cycle so that a high final strength in the formed, painted part can be achieved.

SUMMARY OF THE INVENTION

The invention provides an aluminum alloy material consisting essentially of, by weight percent, 1% to 1.8% Cu, 0.8% to 1.4% Mg, 0.2% to 0.39% Si, 0.05% to 0.4% Fe, 0.05% to 0.40% Mn, with the balance aluminum with normal impurities. The percentage of Mg by weight is preferably approximately equal to $\%Cu/2.2+1.73\times\%Si$. These ratios of ingredients allow formation of the precursors of the metastable $\beta$-$Mg_2Si$ Precipitate and the S' phase, which is an $Al_2CuMg$ precipitate. The foregoing alloy appears to achieve a desirable balance between formability and strength, particularly when age hardened during the paint bake cycle after forming desired sheets or panels.

The invention also provides a process of making an improved aluminum alloy, comprising the steps of forming an aluminum alloy consisting essentially of, by weight percent, 1% to 1.8% Cu, 0.8% to 1.4% Mg, 0.2% to 0.39% Si, 0.05% to 0.4% Fe, 0.05% to 0.40% mn, with the balance aluminum with normal impurities. The aluminum alloy may be formed into sheets or other workpieces which are then heat treated and age hardened at a temperature and for a time period effective to form metastable precursors of the $Mg_2Si$ and $Al_2CuMg$ precipitates within the alloy. These precipitates strengthen the alloy.

The invention further embraces aluminum alloy sheets, articles and automobile body parts produced by the foregoing process and possessing the advantageous combination of mechanical properties achieved thereby.

Further features and advantages of the invention will be apparent from the detailed description hereinbelow set forth, together with the accompanying drawings.

DETAILED DESCRIPTION OF THE PREFERRED EMBODIMENT

The invention provides an aluminum alloy material having improved formability without sacrificing strength. In particular, the improved alloys of the present invention display good strength properties, particularly after heat treatment and age hardening during the paint bake cycle. The inventive alloy consists essentially of, by weight percent, 1% to 1.8% Cu, 0.8% to 1.9% Mg, 0.2% to 0.6% Si, 0.05% to 0.4% Fe, 0.05% to 0.40% Mn, with the balance being aluminum with normal impurities. In this alloy the precipitation rate at room temperature is slow, but at higher temperatures the age hardening rate is high due to the precipitation of multiple metastable phases.

The invention further provides an aluminum alloy material consisting essentially of, by weight percent, 1.3% to 1.6% Cu, 1.0% to 1.4% Mg, 0.25% to 0.39% Si, 0.1% to 0.3% Fe, 0.05% to 0.2% Mn, with the balance being aluminum including normal impurities.

The aluminum alloy material is preferably and advantageously strengthened by heat treatment and age hardening cycles. It may be heat treated, for example, in a paint baking cycle after application of paint, enamel or lacquer. Following solution heat treatment and quenching, the alloy is preferably allowed to stabilize at room temperature for about a week. Subsequent age hardening occurs during the paint baking after forming the final shape, and the metastable phases are precipitated.

The invention also provides a method of making an improved aluminum alloy, comprising the steps of forming an aluminum alloy consisting essentially of, by weight percent, 1% to 1.8% Cu, 0.8% to 1.4% Mg, 0.2% to below 0.4% Si, 0.05% to 0.4% Fe, 0.05% to 0.40% Mn, with the balance being aluminium with normal impurities. The DC ingot may then be homogenized at between 500° and 580° C. for between 2 and 8 hours using a heating rate of about 30° C. per hour. The ingot is then rolled to final sheet gauge and solution heat treated at between 480° and 575° C. and rapidly cooled to room temperature using an appropriate quenching method. The sheet is then preferably allowed to stabilize for about one week at room temperature, followed by forming to final shape.

Advantageously, if the aluminum alloy sheet after stamping the sheet into a desired shape is primed and painted on one or both sides, the baking cycle can cure the paint and harden the alloy at the same time, providing a desirable strength to the final shape.

The composition limits for the inventive aluminum alloy material were established as follows. Copper contributes to the increased strength of the present aluminum alloy. Preferably, the total copper content should range from about 1% to about 1.8% by weight, with 1.3% to 1.6% being most preferred at present. The copper combines with aluminum and magnesium to form an S' phase of $Al_2CuMg$ precipitate after heat treatment.

Silicon, although present as an impurity in some aluminum alloys, increases strength in the alloys of the present invention. The silicon content is maintained in the range of about 0.2% to 0.39%, with about 0.25% to 0.38% being preferred. It is preferable for the composition of the alloy to have Cu below 1.8% and Si below 0.4% to avoid the formation of insoluble Q phase which degrades mechanical properties.

Also, from 0.8% to about 1.4% magnesium (Mg) is added to the alloys of the present invention, although 1.0% to 1.4% Mg appears preferable. The magnesium concentration (Mg) should be below 1.5% and should be adjusted to provide a sufficient concentration of magnesium to form the precursors for both the metastable beta $Mg_2Si$ precipitate, and the S' phase, which is an $Al_2CuMg$ precipitate. The Mg concentration actually desired can be expressed mathematically as a function of copper and silicon concentrations:

$$\% Mg \pm 0.2\% = \% Cu/2.2 + 1.73 \times \% Si$$

This relationship, if reached in the alloy, helps assure that the $Mg_2Si$ phase will be present in an alloy in which the Mg/Si ratio (by weight) is about 1.73. The concentration of Mg provides sufficient additional Mg to form the $Al_2CuMg$ phase.

The iron (Fe) content of the alloy of the present invention ranges from about 0.05 to about 0.4% Fe, and preferably is 0.1% to 0.3% Fe. These concentrations correspond to the iron impurity levels in most commercial aluminum. Higher concentrations are undesirable, and may degrade the alloy.

The alloy also includes Manganese (Mn). Its concentration in the alloy is preferably maintained at 0.05% to 0.4%, although the most desired range appears to be 0.05% to 0.2%.

The present invention thus provides precursors of two or more strengthening precipitates which are formed during age hardening of the workpieces made from the alloy. At the same time, the alloy may be rather easily formed into work pieces prior to heat treatment and age hardening. As mentioned above, during the heat treatment and age hardening process, two precipitate phases are formed. The most likely phases are metastable beta $Mg_2Si$ and S' $Al_2CuMg$. The kinetics of the formation of these two precipitated phases are different, and thus make it possible for one alloy composition to provide strength upon heat treatment under a variety of conditions.

Previously, each of the alloys used in the manufacture of automobile panels, such as hoods, trunks, doors, fenders, and the like, had distinct and unique requirements for age hardening, which resulted in a different alloy being required whenever the heat treatment specification was altered. The composition of the present invention, on the other hand, may be used in a wider variety of applications and specifications. It provides high formability which facilitates stamping of automobile door panels, hood lids and trunk lids, for example. Once formed, the panels may be heat treated and age hardened according to a variety of techniques, but preferably this tempering step is combined with the paint baking cycle. That is, the requisite primer and paint layers are applied to the panel which has already been formed into the desired shape. The panel is passed through an oven or furnace to cure the paint and increase the strength of the final part.

The following examples are intended to illustrate the practices of the invention and are not to be construed as limiting.

EXAMPLE I

Four alloys were cast in 75×230×500 mm DC ingot. Their chemical composition is listed in Table 1:

TABLE 1

| CHEMICAL COMPOSITION OF ALLOYS | | | | | | |
|---|---|---|---|---|---|---|
| Alloy | Cu | Mg | Si | Fe | Mn | Others + |
| KSE | 1.10 | 0.88 | 0.26 | 0.14 | 0.08 | Al |
| KSF | 1.12 | 1.08 | 0.34 | 0.15 | 0.08 | Al |
| KSG | 1.52 | 1.22 | 0.33 | 0.15 | 0.08 | Al |
| KSH | 1.62 | 1.54 | 0.50 | 0.16 | 0.08 | Al |

The alloys were scalped, homogenized (at heating rate of 30° C./h) at 530° C. for 6 hours, hot rolled to ~4.0 mm and cold rolled to the final gauge of 1. 0 mm. They were solution heat treated in a fluidized sand bed at 53020 C. for 30 seconds, water quenched and aged at room temperature for a period of about one week (T4 temper). The alloys were optically examined and tested to determine mechanical properties of interest in T4 temper.

The following standard tests were performed on the alloys and samples of commercially available alloys:

Yield strength at T4 (ksi), is the measurement of yield strength at T4 temper, as determined by ASTM METHOD E 8M-89, paragraph 7.3.1, "Offset Method". The yield strength, expressed in units of thousands of pounds per square inch (ksi) is a criterion which determines if the material can be used for specific applications.

Elongation, expressed in terms of percentage (%) elongation before failure, is another measure of the formability, and was determined by ASTM METHOD E 8M-89, paragraph 7.6.

Bendability, expressed in as r/t, where r is the radius of the bend and t is the thickness of the sheet prior to failure, is another measure of the formability of the alloy, and was determined by ASTM METHOD E 290-87.

Erichsen Cup, or the Ball Punch Deformation Test is another test regarding formability, and is expressed in the height in inches, of a dome attained by pressing a sphere into the sheet, until the sheet ruptures. It was carried out by ASTM METHOD E643 - 84.

Grain size is the measurement under the optical microscope of the grain size of the metal structure. The grain size, should be less than 70 μm so that the sheet will be easily deformable, without defects.

Tensile tests were also conducted in T8X temper (2% stretch+177° C. for ½ hour), which is a test designed to replicate the forming and baking operation used in the U.S. auto-industry. The T8X test involves the following steps:

prepare a specimen to T4 temper as outlined above.

apply a 2% deformation to the specimen, and age at 177° C. for ½ hour.

measure the Yield Strength in ksi according to the ASTM METHOD E8 - 89.

The average tensile properties of KSE, KSF, KSG, and KSH alloys are summarized below in Table 2, which also includes the results of the Erichsen cup height, minimum bend radius and grain size measurements. It can be seen that tensile properties in T4 condition vary between 17.9 to 24 ksi Y.S., between 38.3 to 47.1 ksi U.T.S., and between 28 to 28.2% elongation. The KSE alloys represent the lower end and KSH alloy the upper end of tensile properties. In T8X temper, the KSE, KSF, KSG, and KSH alloys show significant increase in tensile properties giving values between 25.9 and 33.4 ksi Y.S. and 40.4 and 47.1 ksi U.T.S. along with a slight decrease in elongation (27 to 26%).

TABLE 2

MECHANICAL PROPERTIES OF THE EXPERIMENTAL LABORATORY MADE ALLOYS

| Properties | Alloys | | | |
|---|---|---|---|---|
| | KSE | KSF | KSG | KSH |
| Yield Strength at T4 (ksi) | 17.9 | 20.3 | 23.9 | 24.0 |
| Elongation (%) | 28.0 | 28.5 | 28.3 | 28.2 |
| Bendability, r/t | 0.205 | 0.305 | 0.41 | 0.68 |
| Erichsen (inches) | 0.34 | 0.33 | 0.32 | 0.32 |
| Grain Size (μm) | 27.0 | 20.0 | 18.0 | 20.0 |
| Yield Strength at T4 + 2% Stretch + P.B.* (177° C., ½ h) (ksi) | 25.9 | 29.3 | 32.9 | 33.4 |

*Paint Bake cycle.

The bendability of the alloys vary between 0.21 and 0.68, with the KSE alloy, being the best at 0.2, and the KSH, the worst, providing 0. 6. All of the alloys provide Erichsen cup height close to one another (with a range of 0.34 to 0.32).

The above mentioned results show that the alloys of the present invention compare favorably with sheet alloys currently used f or making auto body panels. Table 3 lists mechanical properties of a few of the existing X611, X613, 6111 and 6009 alloys for comparison. It appears that the KSE, KSF and KSG compare favorably to commercially produced 6009, X613 and 6111 alloys respectively.

TABLE 3

NOMINAL COMPOSITION OF COMMERCIALLY AVAILABLE ALLOYS (WT. %)

| Alloy | Cu | Mg | Si | Fe | Mn | Ti |
|---|---|---|---|---|---|---|
| 6111 | 0.75 | 0.72 | 0.85 | 0.2 | 0.2 | 0.02 |
| 6009 | 0.33 | 0.50 | 0.80 | 0.25 | — | 0.02 |
| X611 | — | 0.77 | 0.92 | 0.15 | — | 0.06 |
| X613 | 0.77 | 0.75 | 0.65 | 0.12 | 0.15 | 0.06 |

TABLE 4

MECHANICAL PROPERTIES OF COMMERCIALLY MADE ALLOYS

| Properties | Alloys | | | |
|---|---|---|---|---|
| | X611 | X613 | 6111 | 6009 |
| Yield Strength at T4 (ksi) | 21.3 | 21.6 | 25.0 | 18.4 |
| Elongation (%) | 26.5 | 27.5 | 26.9 | 24.8 |
| Bendability, r/t | 0.41 | 0.41 | 0.65 | 0.26 |
| Erichsen (inches) | 0.33 | 0.32 | 0.35 | 0.35 |
| Yield Strength at T4 + 2% Stretch + P.B.* (177° C., ½ h) (ksi) | 29.5 | 29.9 | 32.5 | 27.0 |

*Paint Bake cycle.

table 4 compares the properties of the commercially available alloys, using the same tests used for the results in Table 2.

EXAMPLE II

An alloy, with a composition as stated in Table 5, was cast in 7⅞" long×6" wide×9/16" thick mold. The alloy was scalped, homogenized at 530° C. for 6h, hot and cold rolled to a final gauge of 1.0 mm. The cold rolled material was solution heat treated at 530° C. for 30 seconds, water quenched and aged at room temperature for one week (T4 temper). Thereafter, the following tests were conducted;

(1) Tensile test in triplicate from transverse to the rolling direction;

(20 Erichsen cup height (average of four); and (3) Minimum-bend-radius to thickness ratio, r/t, in longitudinal and transverse directions. The tensile tests were also conducted in T8X (T4+2% stretch+½ h @177° C.) temper.

The data in Table 6 includes the average results of the experiments. The T4 properties are 21.6 ksi yield strength (Y.S.) and 23.7% total elongation (% el.). In the T8X temper, the strength value increases by ~10% reduction in % el to values 32.0 ksi Y.S. and 21.3% el. The alloy shows the average values or r/t and Erichsen cup height to be 0.35 and 0.3" respectively.

TABLE 5

CHEMICAL COMPOSITION (WT %) OF THE EXPERIMENTAL ALLOY

| Designation | Cu | Mg | Si | Fe | Mn | Other + Al |
|---|---|---|---|---|---|---|
| LDA | 1.50 | 1.38 | 0.38 | 0.14 | 0.01 | Al |

TABLE 6

MECHANICAL PROPERTIES OF THE LDA ALLOY

| Properties | LDA |
|---|---|
| Yield Strength at T4 (ksi) | 21.6 |
| Elongation (%) | 23.7 |
| Bendability, r/t | 0.35 |
| Erichsen (inches) | 0.30 |

TABLE 6-continued

| MECHANICAL PROPERTIES OF THE LDA ALLOY | |
|---|---|
| Properties | LDA |
| Grain Size (μm) | 30 |
| Yield Strength at T4 + 2% Stretch + P.B.* (177° C., ½ h) (ksi) | 32.0 |

*Paint Bake Cycle.

We claim:

1. An aluminum alloy material consisting essentially of, by weight percent, 1% to 1.8% Cu, 0.8% to 1.4% Mg, 0.2% to 0.39% Si, 0.05% to 0.4% Fe, 0.05% to 0.40% Mn, with the balance being aluminum including normal impurities, wherein the percentage of Mg by weight is approximately equal to % C 12.2+1 .73×% Si.

2. An aluminum alloy material in accordance with claim 1, wherein the alloy includes at least two precipitate phases formed during heat treatment and age hardening of the aluminum alloy material.

3. An aluminum alloy material in accordance with claim 2, wherein the two precipitate phases include a metastable beta phase of $Mg_2Si$ and an S' phase of $Al_2$ CuMg.

4. An alloy in accordance with claim 3, wherein the Cu, Mg and Si contents provide the precursors for the metastable beta phase and the S' phases.

5. An alloy in accordance with claim 4, wherein the metastable beta phase and the S' phase are formed by heat treating and age hardening the aluminum alloy material.

6. An aluminum alloy material in accordance with claim 5, wherein the heat treating cures the paint applied to a panel of the aluminum alloy material.

7. An aluminum alloy material consisting essentially of, by weight percent, 1.3% to 1.6% Cu, 1.0% to 1.4% Mg, 0.25% to 0.39% Si, 0.1% to 0.3% Fe, 0.05% to 0.2% Mn, with the balance being aluminum including normal impurities, wherein the percentage of Mg by weight is approximately equal to % Cu 12.2+1. 73×% Si.

8. An aluminum alloy material in accordance with claim 7, wherein the aluminum alloy material is heat treated and age hardened.

9. An aluminum alloy material in accordance with claim 8, wherein the alloy forms two precipitate phases during heat treatment and age hardening.

10. An aluminum alloy material in accordance with claim 9, wherein the two precipitate phases include a metastable beta phase of $Mg_2Si$ and an S' phase of $Al_2$ CuMg.

11. An aluminum alloy material in accordance with claim 10, the Cu, Mg and Si contents provide precursors for metastable beta and S' phases.

12. A method of making an improved aluminum alloy, comprising:

forming an aluminum alloy consisting essentially of, by weight percent, 1% to 1.8% Cu, 0.8% to 1.4% Mg, 0.2% to 0.39% Si, 0.05% to 0.4% Fe, 0.05% to 0.40% Mn, with the balance aluminum with normal impurities, wherein the percentage of Mg by weight is approximately equal to % Cu/2.2+1.73×% Si;

forming aluminum alloy sheets from the aluminum alloy;

stamping the aluminum alloy sheets into workpieces; and heat treating and age hardening the workpieces at a temperature and for a time period effective to form metastable beta $Mg_2Si$ precipitate and a metastable $Al_2CuMg$ precipitate within the alloy.

13. A method in accordance with claim 12, wherein the $Mg_2Si$ precipitate constitutes metastable beta phase and the $Al_2CuMg$ precipitate constitutes the S' phase within the alloy.

14. A method in accordance with claim 12, wherein the aluminum alloy is in the form of an ingot and wherein the ingot undergoes a homogenization step at a temperature which ranges from about 505° C. to about 580° C.

15. A method in accordance with claim 14, wherein the time period of the homogenization step ranges from about 2 hrs. to about 8 hrs.

16. A method in accordance with claim 15, wherein the ingot is heated at a rate of about 30° C. per hour until the effective temperature is reached.

17. A process in accordance with claim 15, wherein the aluminum alloy sheets are formed by rolling the alloy to a predetermined thickness and solution heat treating the alloy at between about 480° C. and about 575° C., and then quenching the alloy.

18. A process in accordance with claim 17 wherein the aluminum alloy sheet is thereafter allowed to stabilize at about room temperature for about 1 week.

19. Aluminum alloy panels made in accordance with the process of claim 12.

20. Aluminum alloy panels made in accordance with the process of claim 17.

21. Automobile panels made in accordance with the process of claim 18.

* * * * *